US011849295B2

(12) United States Patent
Herger

(10) Patent No.: US 11,849,295 B2
(45) Date of Patent: Dec. 19, 2023

(54) FLAT LOUDSPEAKER

(71) Applicant: Sotis AG, Altdorf (CH)

(72) Inventor: Danilo Herger, Burglen (CH)

(73) Assignee: Sotis AG

( * ) Notice: Subject to any disclaimer, the term of this patent is extended or adjusted under 35 U.S.C. 154(b) by 175 days.

(21) Appl. No.: 17/421,594

(22) PCT Filed: Aug. 17, 2020

(86) PCT No.: PCT/IB2020/057718
§ 371 (c)(1),
(2) Date: Jul. 8, 2021

(87) PCT Pub. No.: WO2021/255510
PCT Pub. Date: Dec. 23, 2021

(65) Prior Publication Data

US 2022/0345821 A1 Oct. 27, 2022

(30) Foreign Application Priority Data

Jun. 16, 2020 (RU) ..... RU2020119926

(51) Int. Cl.
*H04R 7/04* (2006.01)
*H04R 1/02* (2006.01)

(52) U.S. Cl.
CPC ..... *H04R 7/04* (2013.01); *H04R 1/026* (2013.01)

(58) Field of Classification Search
None
See application file for complete search history.

(56) References Cited

U.S. PATENT DOCUMENTS

| | | | | |
|---|---|---|---|---|
| 3,779,336 | A | 12/1973 | Bertagni | |
| 6,332,029 | B1 * | 12/2001 | Azima | H04R 1/021 381/337 |
| 10,231,057 | B2 | 3/2019 | Sato et al. | |
| 2021/0243511 | A1 * | 8/2021 | Guo | H04R 9/02 |

FOREIGN PATENT DOCUMENTS

| | | | | |
|---|---|---|---|---|
| DE | 102014112962 | A1 * | 3/2016 | H04R 31/006 |
| KR | 100298303 | * | 5/2001 | H04R 7/02 |
| RU | 2427100 | C2 | 8/2011 | |
| WO | 9531805 | A1 | 11/1995 | |

* cited by examiner

*Primary Examiner* — Walter F Briney, III

(57) ABSTRACT

The flat loudspeaker including an enclosure in the form of a support frame, a sound-emitting rectangular membrane attached to the frame, and an electrodynamic vibration exciter located opposite the membrane. Besides, the vibration exciter is attached with one of its ends to the membrane within a special line passing along the plane of the rectangular membrane, emerging from any vertex of the rectangular membrane, and ending at a point on the opposite vertex of the membrane's horizontal side located at a distance of ⅔ of the membrane's opposite side from the top horizontally.

12 Claims, 6 Drawing Sheets

FLAT LOUDSPEAKER

CROSS REFERENCE TO RELATED APPLICATIONS

This application is a National Stage Application of PCT/IB2020/057718 filed Aug. 17, 2020, which claims priority from Russian Patent Application No. 2020119926 filed on Jun. 16, 2020. The priority of said PCT and Russian Patent Application are claimed. Each of the prior mentioned applications is hereby incorporated by reference herein in its entirety.

FIELD OF THE INVENTION

The proposed technical solution is an acoustic wave generator that can work as a flat loudspeaker of a wide spectrum as well. A flat loudspeaker designed and manufactured in the proposed manner is intended to provide quality advantages in the performance of acoustic systems. This is the flat acoustic system with a resonant excitation membrane that can be used for high-quality reproduction of music and voice records.

BACKGROUND OF THE INVENTION

There are a lot of conventional acoustic devices, comprising cone, dome, and flat type speakers. Such devices have a number of basic disadvantages, One of the most essential ones is the volume of air masses necessary for the operation of such an acoustic device. And this, in turn, leads to such a major disadvantage as the phase shift and inconsistency, directly depending on the frequency.

Since the speaker is a dipole transmitter, it is necessary to match the positive phase of the speaker's front with the negative phase behind the speaker.

This is exactly why the air-filled enclosure is used, designed accurately to invert the phase from the back of the speaker and add it to the front component. As a result, we get an acoustic system that is tuned for efficient operation within a certain frequency of the acoustic range. In case of a deviation from the tuning frequency, phase modulations occur, introducing parasitic harmonics into the sound record reproduction and distortion of the phase characteristics, as well as modulations that cause changes in the amplitude-frequency response of the sound signal.

There are known attempts to create acoustic devices devoid of these disadvantages. Among them, the flat-type loudspeakers, based on the operation principle of a resonating sound-emitting membrane, hold a special place. Such acoustic devices don't need any enclosures, and feature the bipole audio signal generation mode, that is, basically, in-phase in both directions from the membrane. Empirically, a number of design parameters have been established that directly affect the useful qualities of an acoustic device of this type. Such parameters are indicated in Russian and international patents. Among them are the importance of the membrane's width to height proportional ratio, acoustic vibration exciters' points of attachment, membrane attachment methods, types of actuators used, design of the frame or enclosure, possible ways of aligning the acoustic system's amplitude-frequency response, and other design features.

The recommended techniques and methods vary greatly in different patents. When trying to put them into practice, we face a lot of difficulties in ensuring the required sound quality. The fact that all of the above mentioned design features are closely related to each other is undescribed and disregarded. It is impossible to change one parameter without it affecting the other, then it affecting the other one, etc. In general, the design features described in many patents are more likely to be potentially possible than practically applicable, that is, it all comes down to the possibility to try this or that combination, to use this or that proportion, but no one knows which of them will produce a useful acoustic effect, since it is completely determined by reasonable practicality.

It is known that in loudspeakers, various designs of sound-emitting membranes are used. For example, WO95/31805 patent proposes to use plastic elements of a tablet computer case as a sound-emitting membrane.

The patent of the Russian Federation No. 2692096, describing the properties of the membrane, as well as parameters affecting them (for example, the honeycomb structure of such a panel, reinforcing fibers or spacers and interlacing covering the shell or sheets applied to the core in the specified composite multilayer element, comprising differently oriented or relatively inclined grains on each side or in the form of several layers on each side), assumes the use of a honeycomb structure membrane bent in space.

The patent of the Russian Federation No. 2427100 suggests using glass, wood or plastic as the membrane body. And the patent US 377933 6A proposes a molding of granular polystyrene as a membrane. All these materials' parameters can strongly influence the membrane's physical properties.

However, simply manufacturing a membrane from these materials, without reference to the geometric parameters of the loudspeaker itself, will not improve the sound reproduction quality of the loudspeaker system.

The closest counterpart to our invention is the device described in the U.S. Pat. No. 6,332,029 by Henry Azim dated Dec. 18, 2001. It describes an acoustic device with a flat membrane, containing at least one acoustic vibration drive, installed in space opposite a special place attached to the membrane, operating on the flexural resonance modes principle. Additionally, it presents favorable proportions for the acoustic vibration exciter attachment within the panel area. A number of values are given. For example: 3\7, 4\9, and 5\13, giving 24 possible combinations from each corner. That is, multiple positions of the exciter attachment are suggested.

We have found that the use of such proportions can not ensure the maximum sound reproduction quality of the acoustic system.

SUMMARY OF THE INVENTION

The technical result is an improvement in sound reproduction quality of the acoustic system.

The technical result is achieved by the flat loudspeaker including an enclosure in the form of a support frame, a sound-emitting rectangular membrane attached to the frame, and at least one electrodynamic vibration exciter located opposite the membrane. Besides, at least one vibration exciter is attached with one of its ends to the membrane within a special line passing along the plane of the rectangular membrane, emerging from any vertex of the rectangular membrane, and ending at a point on the opposite vertex of the membrane's horizontal side located at a distance of ⅔ of the membrane's opposite side from the top horizontally; the membrane is made as a honeycomb filler, a surface layer glued to the honeycomb structure on both sides, and a stabilizing impregnating solution based on polyurethane primers and varnishes covers the surface layers.

The layers of the stabilizing impregnating solution based on polyurethane primers and varnishes can also be covered with an additional layer of acrylic polymer.

The honeycomb filler is made of a material composed of: paper, aramid fiber, aluminum, or other metal with a low specific density.

Besides, the rectangular membrane should preferably feature flanging around its perimeter.

If the membrane's stiffness is uniform in different directions, the ratio of the membrane's long side to its short side is 9/5.

If the membrane's stiffness is nonuniform in different directions and the ratio of the membrane's long side to its short side is 9·k/5, where k is the ratio of the membrane's stiffness in the longitudinal direction to the membrane's stiffness in the transverse direction.

Also, the sound-emitting rectangular membrane should be attached to the support frame by means of a foam tape placed around the membrane's perimeter.

BRIEF DESCRIPTION OF THE DRAWINGS

The invention is illustrated by figures.

The Figures Indicate.

1. Sound-emitting membrane.
2. Edging of the panel's end, made of plastic material.
3. Foam tape securing the membrane to the enclosure.
4. Frame.
5. Mounting strap.
6, 6.1-6.5. Electrodynamic acoustic vibration exciter.
7. Amplifier connection terminals,\
8. Honeycomb filler,
9. Covering paper,
10. Impregnating solution based on polyurethane primers and varnishes,
11. Acrylic polymer.

DETAILED DESCRIPTION

As a result of numerous practical studies, we propose a number of technical solutions having a direct positive impact on creating the acoustic systems with excellent consumer properties. This is implemented in a specific physical device and is a methodology for applying technical solutions aimed at providing a positive acoustic effect.

Figure 1:
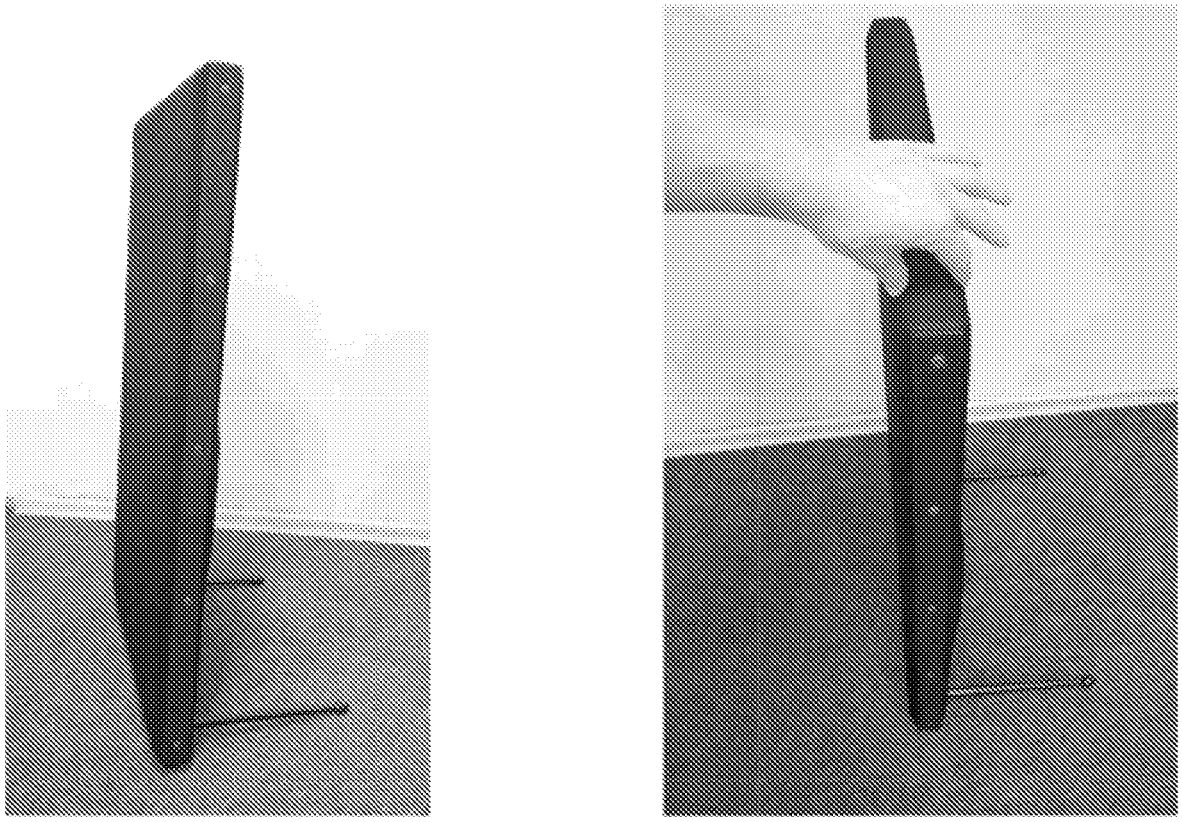
FIG. 1 demonstrates an overview of the proposed flat loudspeaker.
Figure 2:
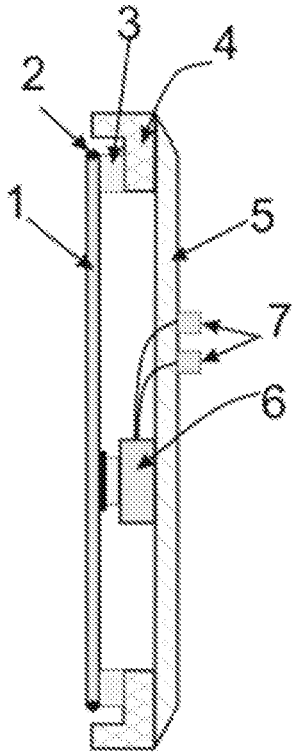
FIG. 2,3 demonstrate the main elements of the proposed flat loudspeaker.
Figure 3:
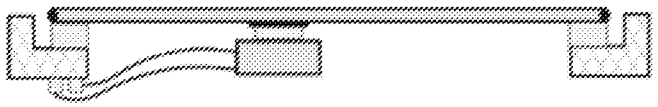

The device consists of a support frame 4 (see FIG. 2), which should be made of an inelastic, plastic material capable of effectively absorbing vibration energy, as well as massive enough to serve as a fulcrum for bending waves that have reached the edge of the panel from the vibration exciter, membrane 1, that is intended to generate acoustic vibrations and transfer them to the air. On the surface of such a membrane, zones associated with different ranges of reproducible frequencies are modulated, but these zones themselves are dispersed over the entire area of the membrane. At least one or several electrodynamic vibration exciters 6 located opposite the membrane and attached to it with one of their ends within a special line (see FIG. 4), passing along the plane of the membrane. Flexible conductive wires, amplifier connection terminals 7 (see FIG. 2).

One of the important design parameters that determine the final sound quality of a flat-type loudspeaker system is the sound-emitting membrane's aspect ratio.

That is, the ratio of its longer side to its shorter side. The preferable aspect ratio of such a membrane has been experimentally established to be at least nine parts of the longer side to five parts of the shorter side. A deviation in the parameters of this proportion is possible. If the membrane's stiffness is nonuniform in different directions. In such a case, the aspect ratio of 9/5 must be adjusted by the k factor. The k factor defines the difference in percentage between the membrane's stiffness in the longitudinal direction relative to the membrane's stiffness in the transverse direction. Thus, if the membrane's stiffness is k percent higher in the longitudinal direction than in the transverse direction, the ratio will be 9k\5.

The other important parameter in designing the loudspeaker system of this type is the position of the exciter within the membrane area. For example, the aforementioned U.S. Pat. No. 6,332,029 patent describing a number of preferable mounting ratios for an acoustic vibration exciter within the panel area. It presents a number of values. For example: 3\7, 4\9, and 5\13, giving 24 possible combinations from each corner. That is, multiple positions of the exciter attachment are suggested.

We have found that the use of such proportions can not ensure the maximum sound reproduction quality of the acoustic system.

Figure 6:
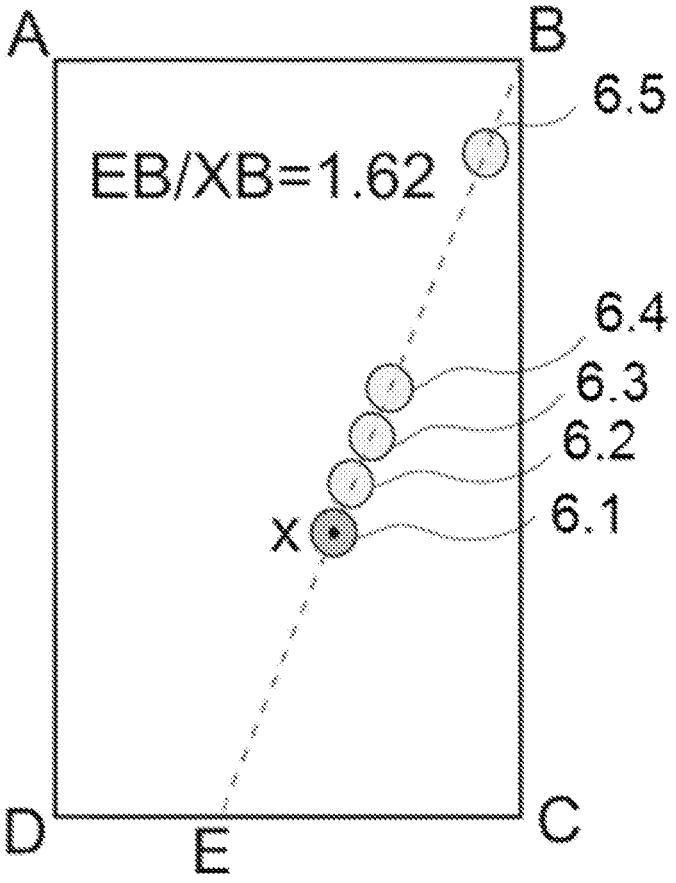
FIG. 6 demonstrates a line for arranging several exciters.

Numerous practical experiments have resulted in establishment of a special EB line (see FIG. 4) passing along the plane of the sound-emitting membrane, within which the acoustic vibrations exciter or several of them should be installed so that the point of the exciter's rotation axis includes a special line, or crosses the front projection of the exciter circuit, installed near the special line. So for a sound-emitting membrane with the angles represented with points A, B, C, and D, a special "red" line of exciters' attachment will pass from point B to point E. In turn, E is a point on the DC side of the membrane where it divides the DC segment in the following proportion: DE \ EC=1 \2. Within the EB line, one or more vibration exciters can be installed (see FIG. 6). For a technical solution with one acoustic vibrations exciter within such a line, it is necessary to determine the X point according to the following proportion: EB \ XB=1.62. For using several exciters within such a line, from point X defining the attachment point of the first exciter 6.1 (see FIG. 6) a number of exciters are mounted in the direction of point B in such a way that the distance between them is as small as possible 6.2, 6.3, 6.4. It is also recommended to use an acoustic vibration exciter designed to work in the high-frequency range, see 6.5, FIG. 6. Such exciter is mounted separately from one or more broadband signal exciters, but within a special "red" EB line, preferably near corner B.

Figure 4:
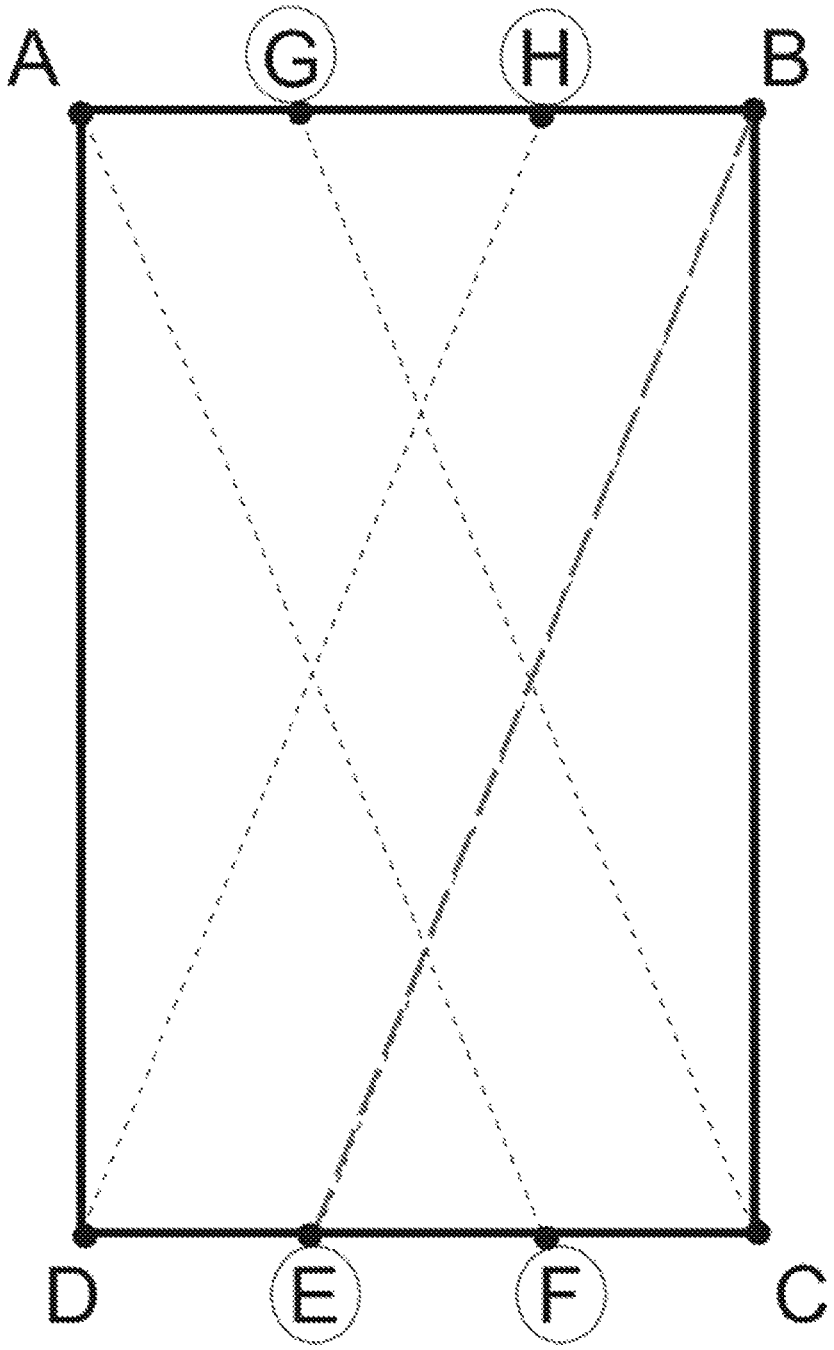
FIG. 4 demonstrates the position of a special (red) line within the plane of the sound-emitting membrane, where it is recommended to place at least one or several acoustic vibration exciters.

Naturally, the red EB line can be symmetrically reflected along any of the membrane's symmetry axes, thus its action equally extends to the AF line, DH line, and CG line (see FIG. 4)

The advantage of the proposed technical solution in the form of a special line within the membrane area, assuming the attachment of excitation sources within it, is ensuring the optimal distribution of resonant modulations within the membrane area, which in turn has a positive effect on the uniformity of the amplitude-frequency response, as well as ensuring sound naturalness, closely related to the total amount of distortions caused by the speaker system's operation, reduction of phase shifts, as well as ensuring the maximum frequency range in the operation of such a system.

Another important parameter that directly ensures favorable acoustic effect is the membrane.

Figure 5:
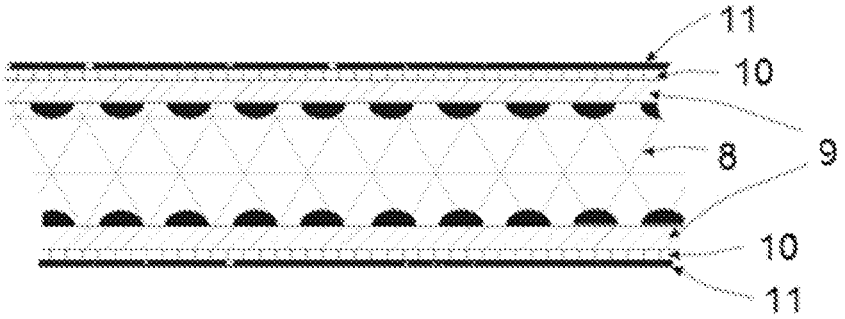
FIG. 5 demonstrates a structural section of the sound-emitting membrane.

Numerous practical studies resulted in identifying the optimal design solution for a sound-emitting resonant-type membrane (see FIG. 5). Such a membrane consists of honeycomb filler 8, which is a honeycomb structure, consisting of various materials such as paper, aramid fiber, aluminum, or another metal with a low specific density. It contains sheets of the surface layer 9, glued to the honeycomb structure on both sides with an adhesive composition that can withstand repeated vibration bending oscillations. It is proposed to use paper 9 with a density of 30 to 125 g per square meter of area as a covering material. Next, a stabilizing impregnating solution based on polyurethane primers and varnishes 10, impregnating the covering paper 9. If necessary, a layer of acrylic polymer 11, comprising micron-scale grinding of mineral and organic substances (quartz, walnut shells, rice and rice husks, etc.) is used.

Layers 10 and 11 in FIG. 5 largely determine the sound-emitting membrane's elastic-plastic properties, and the final tonal balance of the amplitude-frequency response—the parameter responsible for the reliability of the sound content reproduction. The importance of reducing the final mass of the finished membrane as much as possible was also revealed. This directly affects loudspeaker system's sensitivity; all other things being equal, the less is the membrane's mass, the higheris the rise rate of the pulse signal front.

The actual density of the fully finished sound-emitting membrane, which is in the range of 350-750 g/1 sq. meter, is of practical value. The membrane also includes an edge treatment: flanging of a semicircular sponge around the entire membrane's perimeter.

Flanging is made of a material featuring relatively high (plastic) specific density and high-level plasticity, which contributes to the rapid attenuation of vibrations in the thickness of such material. Flanging 2 (see FIG. 2) serves to increase the mass of the membrane's edges, to support the surface-traveling wave, concentrically diverging from the source of acoustic influence towards the membrane's edges, and to effectively reflect this wave in the opposite direction to ensure the modulated zones oscillation mode of frequency-dependent amplitude burst.

The internal structure of the honeycomb membrane can be from 3 to 7 mm thick in practical application. The thickness and stiffness parameter should be linked to the absolute size of the membrane. The absolute size of the membrane of a particular stiffness is recommended based on the coefficient revealed by experimental studies.

In addition to the above mentioned technical solutions, it is necessary to mention the importance of the way the membrane is fixed in the frame of the acoustic device. This is the key parameter determining the correct location of amplitude modulations within the panel area, which in turn completely determines the acoustic properties of a flat loudspeaker.

We also identified a practically preferable method of attaching the membrane to the support frame, ensuring the best distribution of the zones of increased vibration amplitude frequency modulations on its surface. It is a semi-open attachment type, in which a foam tape is mounted to one side of the membrane along the entire perimeter, which in turn is most often a 10 mm gap between the membrane and the supporting frame. This foam tape holds the membrane's end to provide the required support mass (along with the edging of the membrane's end with a plastic material) when converting a surface-traveling primary wave, diverging from the source of acoustic excitation and processing it into a secondary surface-traveling wave, with the interference of which from the primary will be formed zones of increasing amplitude within the panel, which is the key to effective operation of the acoustic system itself. The semi-open attachment type contributes to the effective performance of the foam rubber's other function-providing acoustic isolation between the membrane and the support frame, which drastically affects the sound quality, reducing harmonic distortions in the process of generating an acoustic signal.

The suggested technical solution allows, with less labor and material costs, to achieve, within one membrane, a significant improvement in the quality characteristics of the loudspeaker system. At the same time, a significant increase in quality is possible with the use of a minimum number of acoustic pathogens, which leads to savings in money and materials.

Application of the design methods and technical solutions described in our patent makes it possible to create a full-range loudspeaker system. In practice, this means that a compact (flat) device can generate the entire spectrum of sound audible to the human ear in the range from 20 Hz to 20,000 Hz. While the level of harmonic distortion is reduced to a minimum, when we can talk about the implementation of the highest class acoustics in practice.

This is largely due to the technical solutions described above, designed to control the process of correct distribution of the vibration amplitude's frequency-dependent burst zones over the area of the sound-emitting membrane. Their correct distribution, reflected in the frequency response graph as a line with minimal deviations from the straight line, implements such a useful acoustic effect as a decrease in the "doppler effect" of the sound generation in a wide range. This harmful phenomenon is characterized by distortions for the listener, caused by the fact that when different frequencies are generated simultaneously by one speaker, a low frequency of a higher amplitude turns out to be a carrier for higher frequencies with a lower amplitude. As a result, the high-frequency component is approaching the listener and moving away from them in turn, causing the "tremolo" effect, distortion in the form of sound jitter.

The invention claimed is:

1. A flat loudspeaker comprising:

an enclosure having a support frame;

a rectangular membrane attached to the frame and having four corner and four sides;

a flanging around a perimeter of the rectangular membrane; and at least one electrodynamic vibrations exciter having a moveable end to the membrane within a special line passing along a plane of the rectangular membrane, emerging from a first one of said corners of the rectangular membrane, and ending at a point on the membrane side opposite to the first one of said corners located at a distance of ⅔ between the corner opposite to the first one of said corners, and another one of the corners;

wherein the membrane comprises first and second surface layers adhered to respective first and second sides of a honeycomb filler, and a stabilizing impregnating solution based on polyurethane primers and varnishes covering the surface layers.

2. A flat loudspeaker according to claim 1, further comprising acrylic polymer layers applied to the stabilizing impregnating solution based on polyurethane primers and varnishes covered surface layers.

3. A flat loudspeaker according to claim 1, wherein the honeycomb filler is made of a material composed of at least one of paper, aramid fiber, aluminum, or other metal with a low specific density.

4. A flat loudspeaker according to claim 1, wherein the membrane has a uniform stiffness in different directions of a longitudinal direction and transverse direction; and the ratio of the membrane's long side to the short side is 9/5.

5. A flat loudspeaker according to claim 1, wherein the membrane has a nonuniform stiffness in different directions of a longitudinal direction and transverse direction; the ratio of the membrane's long side to its short side is 9·k/5, where k is the ratio of the membrane's stiffness in the longitudinal direction to the membrane's stiffness in the transverse direction.

6. A flat loudspeaker according to claim 1, wherein the rectangular membrane is attached to the support frame by a foam tape placed around the membrane's perimeter.

7. A flat loudspeaker comprising:

an enclosure having a support frame;

a rectangular membrane attached to the frame and having four corner and four sides; and at least one electrodynamic vibrations exciter having a moveable end to the membrane within a special line passing along a plane of the rectangular membrane, emerging from a first one of said corners of the rectangular membrane, and ending at a point on the membrane side opposite to the first one of said corners located at a distance of 2.13 between the corner opposite to the first one of said corners, and another one of the corners;

Wherein the membrane comprises first and second surface layers adhered to respective first and second sides of a honeycomb filler, and a stabilizing impregnating solution based on polyurethane primers and varnishes covering the surface layers, and wherein the membrane has a nonuniform stiffness in different directions of a longitudinal direction and transverse direction; the ratio of the membrane's long side to its short side is 9·k/5, where k is the ratio of the membrane's stiffness in the longitudinal direction to the membrane's stiffness in the transverse direction.

8. A flat loudspeaker according to claim 7, further comprising flanging around the rectangular membrane's perimeter.

9. A flat loudspeaker according to claim 7, further comprising acrylic polymer layers applied to the stabilizing impregnating solution based on polyurethane primers and varnishes covered surface layers.

10. A flat loudspeaker according to claim 7, wherein the honeycomb filler is made of a material composed of at least one of paper, aramid fiber, aluminum, or other metal with a low specific density.

11. A flat loudspeaker according to claim 7, wherein the membrane has a uniform stiffness in different directions of a longitudinal direction and transverse direction; and the ratio of the membrane's long side to the short side is 9/5.

12. A flat loudspeaker according to claim 7, wherein the rectangular membrane is attached to the support frame by a foam tape placed around the membrane's perimeter.

* * * * *